US010363593B2

(12) United States Patent
Kim et al.

(10) Patent No.: US 10,363,593 B2
(45) Date of Patent: Jul. 30, 2019

(54) MULTI-FORMING METHOD

(71) Applicant: SUNGWOO HITECH CO., LTD., Busan (KR)

(72) Inventors: Rae Hyeong Kim, Busan (KR); Mun Yong Lee, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 637 days.

(21) Appl. No.: 15/156,486

(22) Filed: May 17, 2016

(65) Prior Publication Data

US 2017/0182537 A1 Jun. 29, 2017

(30) Foreign Application Priority Data

Dec. 29, 2015 (KR) ..... 10-2015-0188959

(51) Int. Cl.

| | |
|---|---|
| ***B21D 22/02*** | (2006.01) |
| ***B21D 22/20*** | (2006.01) |
| ***B21D 26/021*** | (2011.01) |
| ***B21D 26/055*** | (2011.01) |

(52) U.S. Cl.

CPC ..... *B21D 22/022* (2013.01); *B21D 22/208* (2013.01); *B21D 26/021* (2013.01); *B21D 26/055* (2013.01)

(58) Field of Classification Search

CPC .. B21D 22/022; B21D 22/208; B21D 24/005; B21D 24/16; B21D 26/021; B21D 26/023; B21D 26/027; B21D 26/055; B21D 37/16

See application file for complete search history.

(56) References Cited

U.S. PATENT DOCUMENTS

| | | | | |
|---|---|---|---|---|
| 6,581,428 | B1 * | 6/2003 | Friedman | B21D 26/029 29/421.1 |
| 2005/0067063 | A1 * | 3/2005 | Schroth | B21D 26/021 148/511 |
| 2006/0277962 | A1 * | 12/2006 | Kruger | B21D 22/02 72/342.7 |
| 2007/0044529 | A1 * | 3/2007 | Kruger | B21D 22/02 72/60 |
| 2009/0205394 | A1 * | 8/2009 | Luckey, Jr. | B21D 26/055 72/379.2 |

FOREIGN PATENT DOCUMENTS

| | | |
|---|---|---|
| CN | 101507998 | 8/2009 |
| CN | 101786128 | 7/2010 |
| DE | 102016111105 | 5/2017 |
| KR | 10-2014-0108978 | 9/2014 |
| WO | 2001/043947 | 6/2001 |

* cited by examiner

*Primary Examiner* — Teresa M Ekiert

(74) *Attorney, Agent, or Firm* — Lex IP Meister, PLLC

(57) ABSTRACT

A multi-forming method, wherein after a material which is heated to a warm-deformation condition in a mold is deformed to a maximum deformation depth through plastic deformation, and the deformed material which is heated to a super plasticity temperature is blow-formed by blowing gas to a final product shape, a product having a deep forming depth and complicated shape can be produced.

19 Claims, 9 Drawing Sheets

MULTI-FORMING METHOD

CROSS-REFERENCE TO RELATED APPLICATION

This application claims priority to and the benefit of Korean Patent Application No. 10-2015-0188959 filed in the Korean Intellectual Property Office on Dec. 29, 2015, the entire contents of which are incorporated herein by reference.

BACKGROUND OF THE INVENTION (a) Field of the Invention

The present invention relates to a multi-forming method. More particularly, the present invention relates to a multi-forming method in which one mold set performs warm forming and blow forming having different temperature conditions from each other so as to produce a product having a complicated forming shape and a large forming depth.

(b) Description of the Related Art

Generally, a warm-forming process has been developed to press a magnesium alloy sheet of a lightweight material of which a density of the metal structure is lower than that of an aluminum alloy sheet, and has recently been under development and is being applied by demand of various press forming methods so as to apply a magnesium alloy sheet to a vehicle body for the purpose of producing a lightweight and high strength vehicle body in America.

That is, a warm-forming method is performed at an intermediate temperature range between cold-forming and hot-forming temperatures, wherein a sheet receives heat energy from a high temperature mold that is heated by a heat source, and press forming is performed under conditions that a yield strength is reduced and an elongation rate is improved.

The magnesium alloy sheet to which the warm-forming method is applied has an HCP (hexagonal closed packed) crystal lattice structure, so it is difficult to apply a press forming method thereto at room temperature due to the crystal structure, and formability is quickly improved by a characteristic that a non-basal plane slip system is activated in a high temperature area (of higher than 200° C.).

However, the magnesium has high specific strength, and it can be light in weight at 30% lighter than an aluminum alloy, but it is disadvantageous in an aspect of cost, corrosion, formability, and welding characteristics compared to other materials such as an aluminum alloy.

Particularly, in a case that a product having a complicated shape or a product having a large deformation depth is produced, there are drawbacks that the number of processes and the number of components are increased due to limitations of formability, forming cost is increased, and productivity is deteriorated.

Meanwhile, an aluminum alloy is disadvantageous in terms of weight compared to a magnesium alloy and is advantageous in an aspect of material cost and formability, and thus a die casting process has been used therewith to produce a product of which a forming shape is complicated and a deformation depth is large.

However, the die casting method injects a molten metal of an aluminum alloy into a die to perform casting, wherein the facility cost is high for mass production, the number of the processes is larger, and there is a drawback in terms of productivity.

Therefore, a new forming method that uses super-plasticity as a physical characteristic of an aluminum alloy has recently attracted attention, wherein the super-plasticity is a characteristic that the material shows extreme ductility without local shrinkage when the material is deformed under a specific temperature condition.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a multi-forming method, wherein after a material which is heated to a warm-deformation condition in a mold is deformed to a maximum deformation depth through plastic deformation, and the deformed material which is heated to a super plasticity temperature is blow-formed by blowing gas to a final product shape, a product having a deep forming depth and complicated shape can be produced.

A multi-forming method according to an exemplary embodiment of the present invention may include a first material supply step in which a sheet having super-plasticity is loaded on a lower mold that is disposed on a lower mold die of a warm-forming mold and on a blank holder that is disposed on the lower mold die through a cushion spring corresponding to a circumference of the lower mold, a material warm-heating step in which an upper mold operated by a slider at an upper portion of a lower mold of the warm-forming mold is lowered to grasp an edge of the sheet together with the blank holder, and the sheet is heated to a warm-forming temperature by a heating cartridge disposed in the upper mold, the lower mold, and a blank holder of the warm-forming mold, a warm-forming step in which a slider of the warm-forming mold is operated, the upper mold is combined with the lower mold and plastic-deforms the sheet to a maximum deformation depth of a product along a lower mold surface of the lower mold at the warm-forming temperature, a material super-plasticity heating step in which the sheet, which is warm-deformed to a maximum forming depth of a product, is unloaded from the warm-forming mold, and the sheet is heated to a super-plasticity temperature in a heating device, a secondary material supply step in which the sheet heated to a super-plasticity temperature on the lower mold that is disposed on the lower mold die of a blow-forming mold and on a blank holder that is disposed on the lower mold die is loaded through a cushion spring corresponding to a circumference of the lower mold, a blow-sealing step in which an upper mold operated by a slider is combined with a lower mold of the blow-forming mold at a predetermined pressure, the upper mold grasps an edge of the sheet together with the blank holder, and a sealing bead formed along an edge circumference of a lower mold of the blow-forming mold and contacts the sheet disposed between the upper mold and the lower mold so as to prevent leakage of the blowing gas used in blow-deforming of the sheet, a blow-forming step in which a blowing gas is supplied into a gap between the lower mold and the sheet through a gas passage that is formed in the lower mold of the blow-forming mold such that the sheet is deformed to a final shape of a product along an upper mold surface of the upper mold, and a product unloading step in which the upper mold is separated from the lower mold to unload a final product, after blow-forming the sheet to a final shape of a product in the blow-forming mold.

The super-plasticity material may be an aluminum alloy plate.

The gas passage may be connected with an outside gas supplier through a gas supply pipe to receive high pressure gas.

A lower mold surface of the lower mold of the warm-forming mold may have an incomplete product shape to deform the sheet only to a maximum forming depth.

An upper mold surface of the upper mold of the blow-forming mold may have a final product shape to deform the sheet to a final shape of a product.

The warm-forming temperature may be set to a value of less than an annealing temperature that lowers potential density within a structure of the material having super-plasticity, in the material warm-heating step.

The warm-forming temperature may be set to one value within a range of 200° C. to 250° C., in which a grain size of an aluminum alloy is increased, strength thereof is decreased, and ductility thereof is increased, in the material warm-heating step.

The plastic deformation of the sheet may be performed by a position movement of the upper mold without pressing of the upper mold, when the upper mold is combined with the lower mold in the warm-forming step.

The heating device may be a high frequency induction heating type or an electricity heating type.

The super-plasticity temperature may be set to one value within a range of 500° C. to 540° C. that forms super-plasticity of an aluminum alloy in the material super-plasticity heating step.

The blow-forming mold may be pre-heated to a predetermined temperature in the secondary material supply step.

The blow-forming mold may be pre-heated to a value within a range of 350° C. to 500° C. in the secondary material supply step, before the blow-forming step.

The sealing bead of the blow-forming mold may include an inner sealing bead that protrudes along an edge circumference of the lower mold and a front end portion thereof contacts the sheet to be forcibly inserted into the sheet, and an outer sealing bead that protrudes along the edge circumference of the lower mold at an outer side of the inner sealing bead and a front end portion thereof contacts the sheet to be forcibly inserted into the sheet.

A height of the inner and outer sealing beads may be set to a value within a range of 40% to 60% of the sheet thickness.

The inner sealing bead may be formed along a trim line of the sheet.

The predetermined pressure may be 400 t in the blow-sealing step.

The pressure of the blowing gas that is supplied between the lower mold and the sheet may be 30 bar in the blow-forming step.

In an exemplary embodiment of the present invention, an aluminum alloy sheet is heated to a value of less than an annealing temperature that lowers potential density within a structure thereof in a warm-forming mold, the sheet is plastic-deformed by combination of molds to be deformed to a maximum forming depth of a product in a warm-forming condition, and the aluminum alloy sheet, which is heated to a super plasticity temperature by a heating device, is blow-formed by blowing gas in a blow-forming mold to be deformed to a final shape of a product, such that a final product having a deep forming depth and complicated shape can be produced through a minimized number of molds.

Particularly, when a product having a deep forming depth and complicated shape is being produced, the number of components is reduced by minimized processes, and it is advantageous in terms of cost.

In addition, a part having a complicated shape is formed by blow forming, wherein a high pressure gas deforms the part without contact with a mold, and thus a defect rate is minimized compared to a conventional die-casting method.

DETAILED DESCRIPTION OF THE EMBODIMENTS

Figure 1:
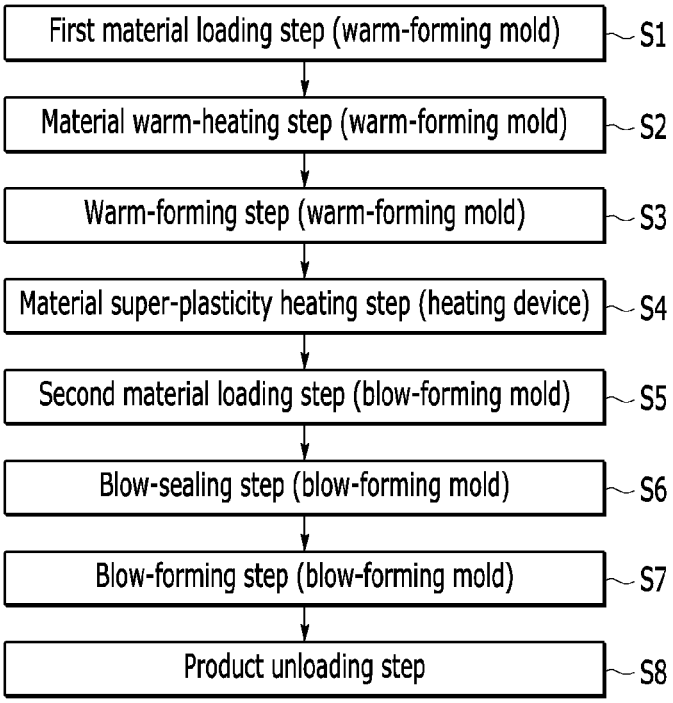
FIG. 1 is a step-by-step process block diagram showing a multi-forming method according to an exemplary embodiment of the present invention.

Hereinafter, an exemplary embodiment of the present invention will be described with reference to accompanying drawings.

The sizes and thicknesses of the configurations shown in the drawings are selectively provided for convenience of description, and the present invention is not limited to those shown in the drawings, and to clearly describe the present invention, parts that are irrelevant to the description will be omitted.

In an exemplary embodiment of the present invention, each component of a warm-forming mold and a blow-forming mold is distinguished by reference numerals.

FIG. 1 is a step-by-step process block diagram showing a multi-forming method according to an exemplary embodiment of the present invention, and FIG. 2 to FIG. 9 are step-by-step process diagrams showing a multi-forming method according to an exemplary embodiment of the present invention.

Referring to FIG. 1, a multi-forming method according to an exemplary embodiment of the present invention warm-forms an aluminum alloy sheet having super-plasticity to maximum deformation depth of a product, then heats the aluminum alloy sheet to a super-plasticity temperature in a heating device, and performs blow-forming to produce a product having a final shape.

Here, the super-plasticity material shows extreme ductility without local shrinkage when the material is deformed under a specific temperature condition, and the material can be an aluminum alloy sheet in an exemplary embodiment of the present invention.

That is, a multi-warm-forming method thereof according to an exemplary embodiment of the present invention performs warm forming that forms a material to a maximum forming depth through pressurized plastic deformation below an annealing temperature that lowers dislocation density within a material having a super-plasticity characteristic and then performs blow-forming that forms a material to a final product shape at a super-plasticity temperature of an aluminum alloy sheet such that a product can be produced by one mold set to have a deep forming depth and a complicated shape.

Figure 2:
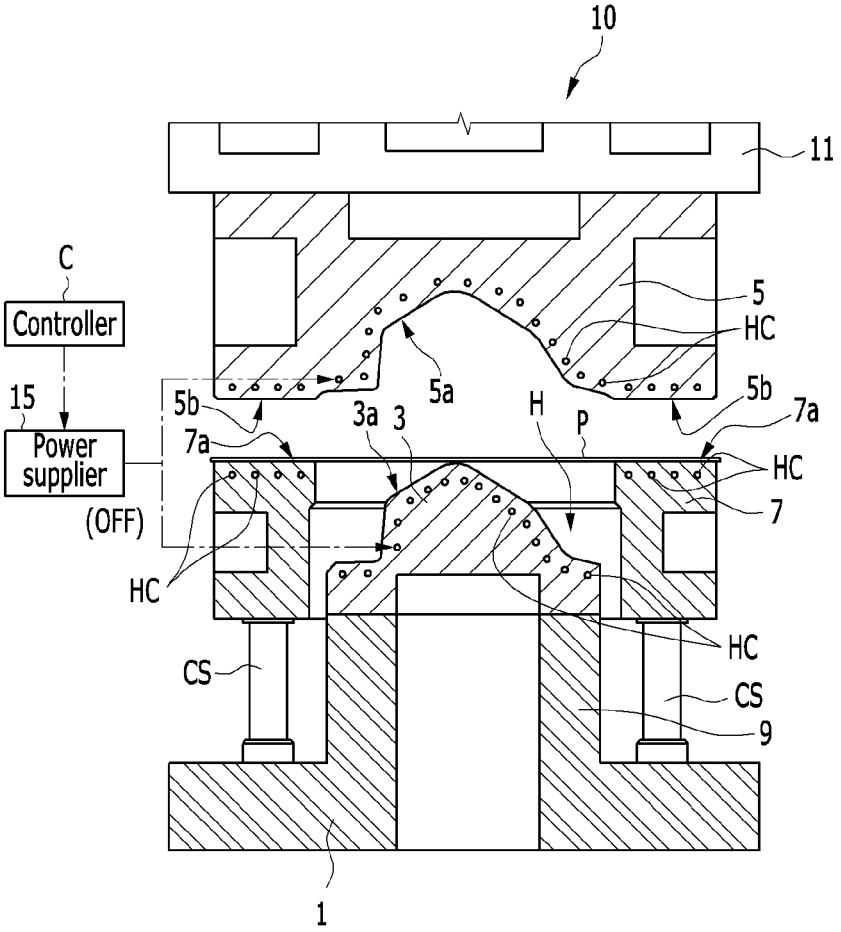
FIG. 2 to FIG. 9 are step-by-step process diagrams showing a multi-forming method according to an exemplary embodiment of the present invention.

Referring to FIG. 2, in an exemplary embodiment for realizing technical effects of the present invention, a warm-forming mold 10 according to a multi-forming method includes a lower mold die 1, a lower mold 3, an upper mold 5, and a blank holder 7.

The lower mold die 1 is disposed on a bolster (not shown) of a process, and a mold mounting portion 9 is formed at a center thereof.

The lower mold 3 is disposed on an upper surface of the mold mounting portion 9 of the lower mold die 1, and a lower mold surface 3*a* is formed on an upper surface thereof. Here, the lower mold surface 3*a* has an incomplete shape so as to form a sheet to a maximum deformation depth.

A plurality of heating cartridges (HC) are buried along the lower mold surface 3*a* to heat the lower mold 3 to a predetermined temperature.

The upper mold 5 is mounted on a slider 11 to move up and down at an upper portion of the lower mold die 1 corresponding to the lower mold 3. Also, the upper mold 5 has an upper mold surface 5*a* at a lower surface corresponding to the lower mold 3, and an upper mold face 5*b* is formed along a circumference of the upper mold surface 5*a*.

A plurality of heating cartridges (HC) are buried along the upper mold surface 5*a* and the upper mold face 5*b* to heat the upper mold 5 to a predetermined temperature.

The upper mold surface 5*a* can have an incomplete shape so as to form a sheet to a maximum deformation depth.

The blank holder 7 has a penetration hole (H) that is formed at a center portion corresponding to the mold mounting portion 9, the mold mounting portion 9 is inserted into the hole (H), and the holder 7 is disposed to move up and down through a cushion spring (CS) that is disposed on the lower mold die 1.

A plurality of heating cartridges (HC) are buried in the blank holder 7 along a holder face 7*a* that grasps an aluminum alloy sheet (P) together with the upper mold face 5*b* at an early state of the forming process to heat the blank holder 7 to a predetermined temperature.

The heating cartridge (HC) receives power from a power supplier 15 according to a control signal of a controller (C) to be operated.

Figure 5:
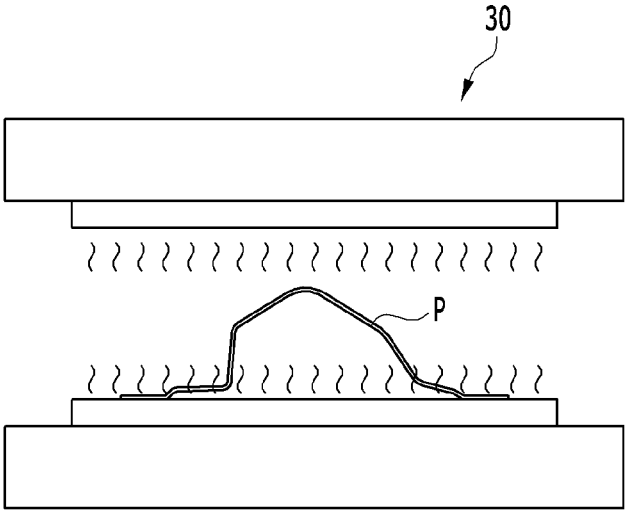

Referring to FIG. 5, the heating device 30 can be a high frequency induction heating type or an electricity heating type, but it is not limited thereto, and it can be an infrared lamp heating device.

The heating device 30 can be a well-known type that can heat the aluminum alloy sheet (P) to a super-plasticity temperature of higher than 500° C., and the detailed description thereof will be omitted.

Figure 6:
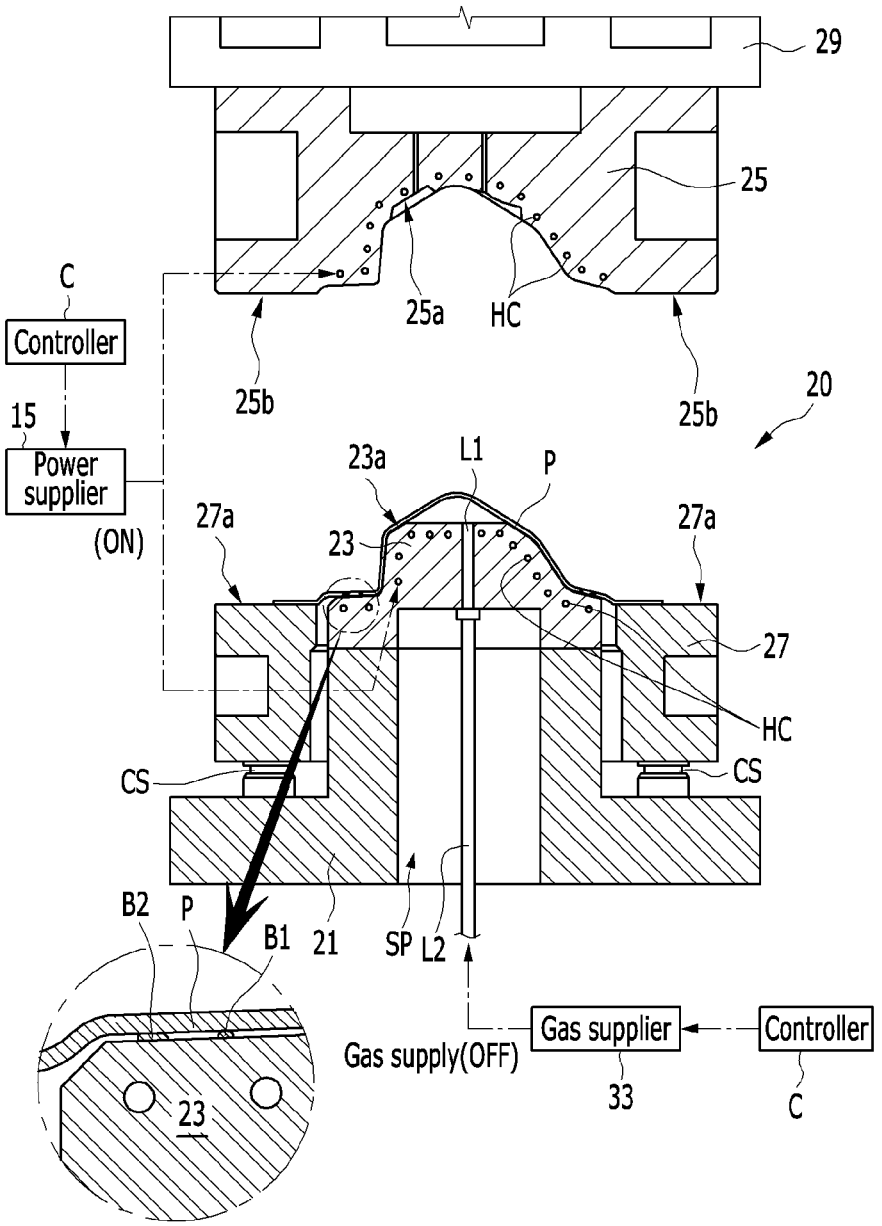

Referring to FIG. 6, a blow-forming mold 20 for the blow-forming includes a lower mold die 21, a lower mold 23, an upper mold 25, and a blank holder 27, in a like manner of the warm-forming mold 10.

The lower mold die 21 is disposed on a bolster (not shown) of a process, and a mold mounting portion 21 having a space portion (SP) is formed at a center thereof.

The lower mold 23 is disposed at an upper surface of the mold mounting portion 21 of the lower mold die 21, a gas passage L1 is formed therein in an up and down direction, and a lower mold surface 23*a* is formed at an upper surface thereof. Also, the gas passage L1 is connected with a gas supplier 33 that supplies blowing gas having a high pressure through a gas supply pipe L2.

The lower mold surface 23*a* has a shape that is lower than the maximum deformation depth so as to effectively supply the blowing gas, and a plurality of heating cartridges (HC) are buried therein along the lower mold surface 23*a* to heat the lower mold 23 to a predetermined temperature.

In a condition in which the gas supply pipe L2 is connected with the gas supplier 33, the gas supply pipe L2 is connected with the gas passage L1 through the space portion SP of the mold mounting portion 21.

A sealing bead is formed at an inner side and an outer side along an edge circumference on the lower mold 23 of the blow-forming mold 20, an inner sealing bead B1 protrudes along an edge circumference of the lower mold 23 and a part of the bead B1 contacting the aluminum alloy sheet (P) is forcibly inserted into the sheet (P), and an outer sealing bead B2 protrudes on an edge circumference of the lower mold 23 along an outside of the inner sealing bead B1 and a part of the bead B2 contacting the aluminum alloy sheet (P) is forcibly inserted into the sheet (P).

Here, a height of the inner sealing bead B1 and the outer sealing bead B2 can be set to a value within a range of 40% to 60% of the thickness of the sheet, and particularly, the inner sealing bead B1 can be formed along a trim line of the sheet.

The double sealing bead B1 and B2 performs a sealing function between the lower mold 23 and the aluminum alloy sheet (P) so as to prevent the leakage of the blowing gas while the aluminum alloy sheet (P) is blow-formed.

The upper mold 25 is mounted on a slider 29 to move up and down corresponding to the lower mold 23 at an upper portion of the lower mold die 21.

Also, the upper mold 25 has an upper mold surface 25*a* at a lower surface thereof corresponding to the lower mold 23, and the upper mold face 5*b* is formed at a circumference of the upper mold surface 25*a*.

Here, a plurality of heating cartridges (HC) are buried inside the upper mold surface 25*a* and an upper mold face 25*b* to heat the upper mold 25 to a predetermined temperature.

The upper mold surface 25*a* has a final product shape to form the sheet to a final shape.

Here, the heating cartridge (HC) receives power from a power supplier 35 according to a control signal of a controller (C) to be operated.

The blank holder 27 has a penetration hole (H) that is formed at a center portion corresponding to the mold mounting portion 21, the mold mounting portion 21 is inserted into the hole (H), and the holder 27 is disposed to move up and down through a cushion spring (CS) that is disposed on the lower mold die 21.

A plurality of heating cartridges (HC) are buried in the blank holder 27 along a holder face 27*a* that grasps an aluminum alloy sheet (P) together with the upper mold face 25*b* in a forming process to heat the blank holder 27 to a predetermined temperature.

Hereinafter, referring to FIG. 2 to FIG. 9, a step-by-step process diagram showing a multi-forming method according to an exemplary embodiment of the present invention will be described.

Referring to FIG. 1, a step-by-step process of a multi-forming method according to an exemplary embodiment of the present invention sequentially performs a first material supply step S1, a material warm-heating step S2, a warm-forming step S3, a material super-plasticity heating step S4, a secondary material supply step S5, a blow-sealing step S6, a blow-forming step S7, and a product unloading step S8.

Referring to FIG. 2, the first material supply step S1 loads a sheet P having super-plasticity on a lower mold 3 that is disposed on a lower mold die 1 of a warm-forming mold 10 and on a blank holder 7 that is disposed on the lower mold die 1 through a cushion spring CS corresponding to a circumference of the lower mold 1.

Figure 3:
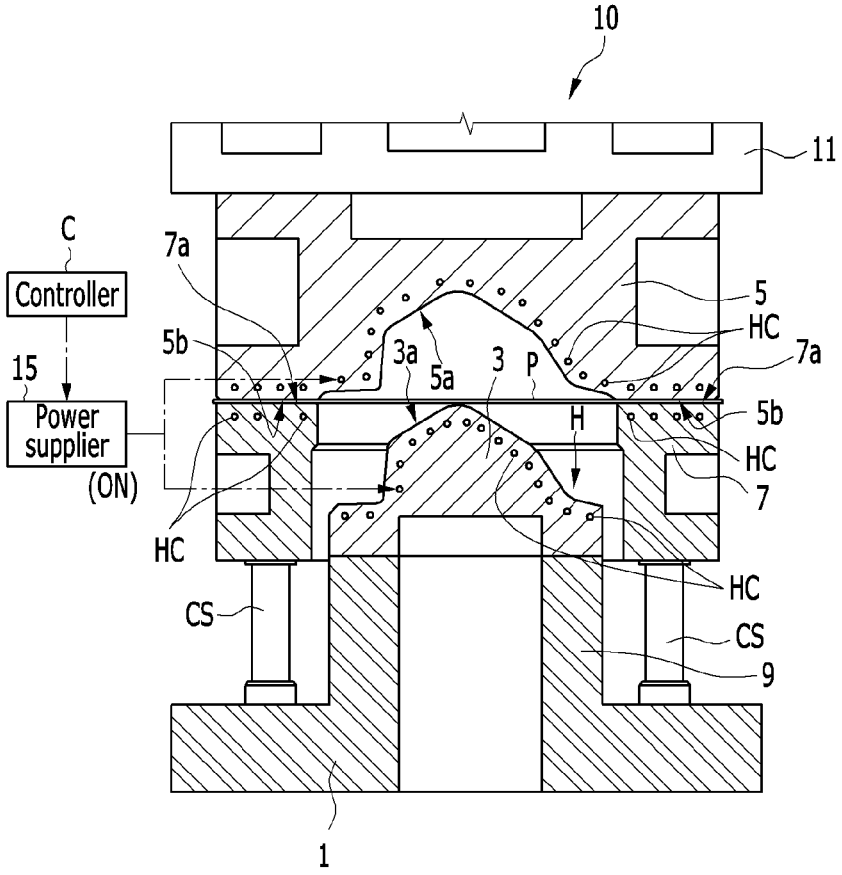

Subsequently, referring to FIG. 3, in the material warm-heating step S2, an upper mold 5 operated by a slider 11 at an upper portion of the lower mold 3 of the warm-forming mold 10 is lowered to grasp an edge of the aluminum alloy sheet P together with the blank holder 7, and the aluminum alloy sheet P is heated to a warm-forming temperature by a heating cartridge HC disposed in the upper mold 5, the lower mold 3, and the blank holder 7 of the warm-forming mold 10.

Here, an edge of the aluminum alloy sheet (P) is held by a surface of an upper mold face 5*b* and a surface of a holder face 7*a* between the upper mold 5 and the blank holder 7, and a warm-forming temperature is set to a value below an annealing temperature that lowers dislocation density within an aluminum alloy sheet (P) having a super-plasticity characteristic.

That is, in the material warm-heating step S2, the warm-forming temperature is set to one value within a range of 200° C. to 250° C., in which a grain size of the aluminum alloy sheet P is increased, strength thereof is decreased, and ductility thereof is increased, and the aluminum alloy sheet (P) at room temperature can be heated to 250° C. in the warm-forming mold 10 according to an exemplary embodiment of the present invention.

Figure 4:
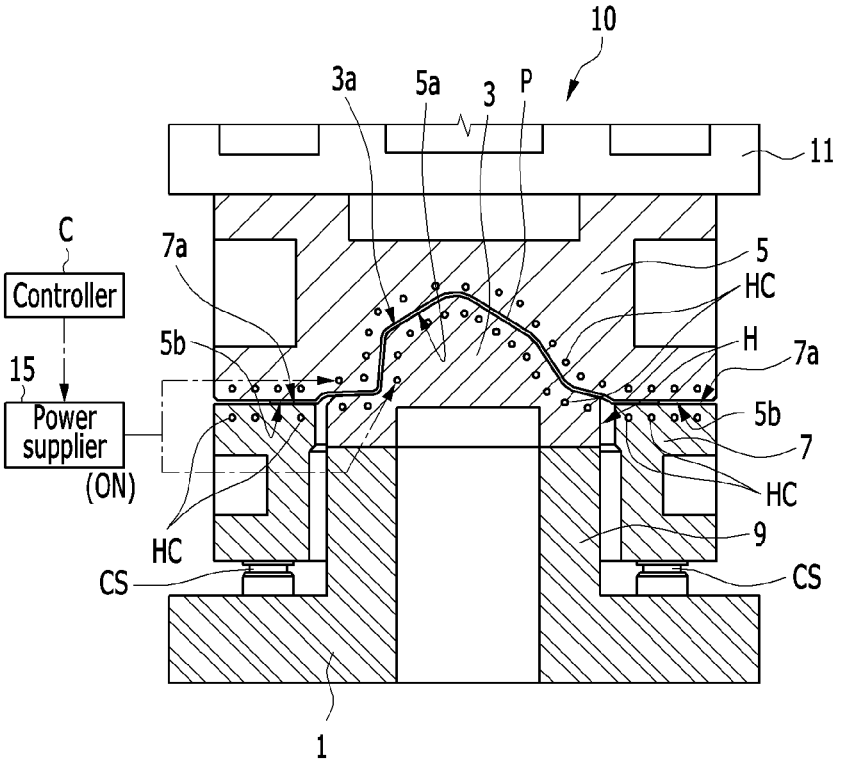

Then, the warm-forming step S3 is performed, and referring to FIG. 4, the warm-forming step S3 operates the slider 11 of the warm-forming mold 10, the upper mold 5 is combined with the lower mold 3 and plastic-deforms the aluminum ally sheet to a maximum deformation depth of a product along a lower mold surface 3*a* of the lower mold 3 at the warm-forming temperature.

In the warm-forming process, the aluminum alloy sheet (P) is plastic-deformed to a maximum deformation depth to have a first forming shape.

Also, in the warm-forming step S3, the plastic deformation of the aluminum alloy sheet (P) is performed by a position movement of the upper mold without pressing of the upper mold, and when the upper mold is combined with the lower mold in the warm-forming step, an edge of the aluminum alloy sheet (P) that is held by an upper mold face 5*b* and the holder face 7*a* between the upper mold 5 and the blank holder 7 is pulled toward the upper mold 5 and the lower mold 3 along the lower mold surface 3*a*.

In this way, the aluminum alloy sheet (P) that is warm-deformed to a maximum deformation depth of a product is loaded into a heating device 30 to perform the material super-plasticity heating step S4.

Referring to FIG. 5, in the material super-plasticity heating step S4, the aluminum alloy sheet (P) that is warm-deformed to a maximum deformation depth of a product is unloaded from the warm-forming mold 10 and the sheet (P) is loaded into the heating device 30 to heat it to a super-plasticity temperature.

The heating device 30 can be a high frequency induction type or an electricity heating type.

Also, the super-plasticity temperature is set to one value within a range of 500° C. to 540° C. that forms super-plasticity of the aluminum alloy sheet in the material super-plasticity heating step S4, and the sheet can be heated to at least 510° C. in the heating device 30 by considering heat loss during the move in an exemplary embodiment of the present invention.

The aluminum alloy sheet (P) is heated to the super-plasticity temperature in the heating device 30, then the secondary material supply step S5 is performed, and referring to FIG. 6, the secondary material supply step S5 loads the aluminum alloy sheet (P) heated to the super-plasticity temperature on the blank holder 27 that is disposed on the lower mold die 21 through a cushion spring CS corresponding to a circumference of the lower mold 23 disposed on the lower mold die 21 of the blow-forming mold 20.

In the secondary material supply step S5, the blow-forming mold 20 maintains its predetermined temperature to prevent cooling of the aluminum alloy sheet (P) heated to the super-plasticity temperature, wherein the blow-forming mold 20 is heated within a range of 350° C. to 500° C. by heating cartridges HC of the upper mold 25, the lower mold 23, and the blank holder 27, before the blow-forming.

Like this, the aluminum alloy sheet (P) heated to the super-plasticity temperature is loaded into the blow-forming mold 20, and the blow-sealing step S6 is performed.

Figure 7:
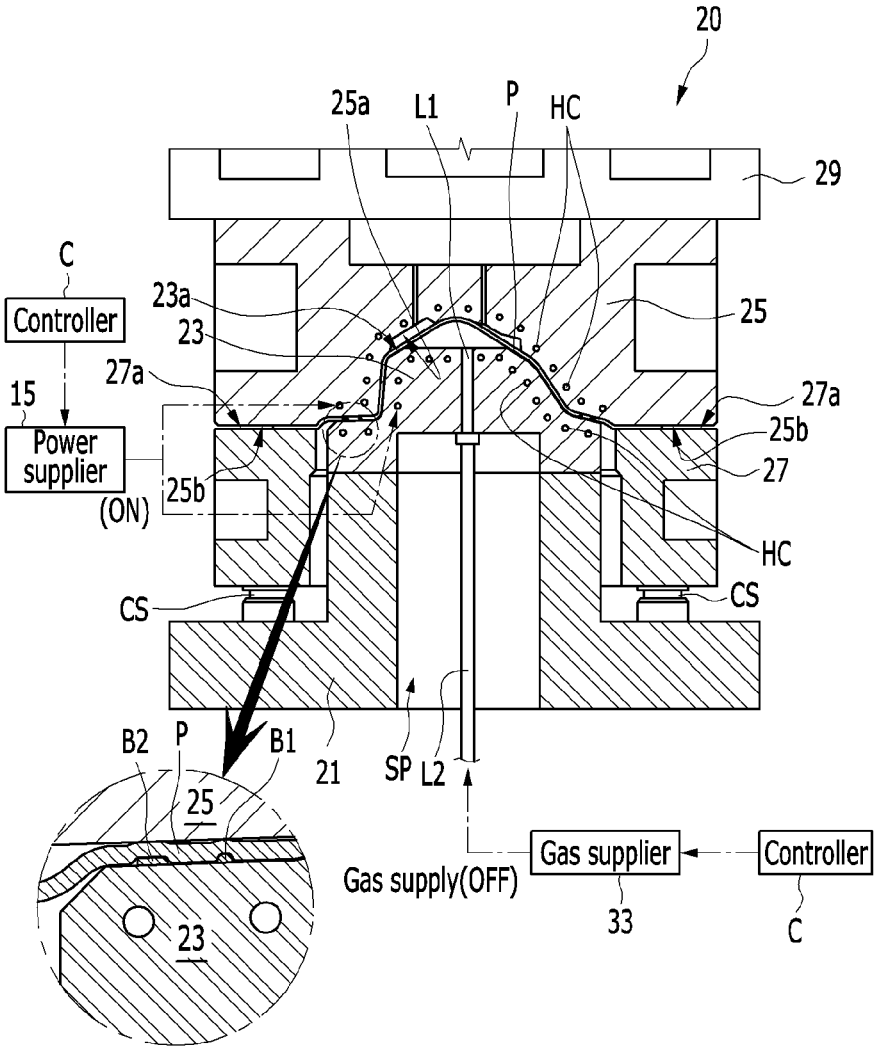

Referring to FIG. 7, the blow-sealing step S6 combines an upper mold 25 operated by a slider with a lower mold 23 of the blow-forming mold 20 at a pressure of 400 t, the upper mold 25 grasps an edge of the aluminum alloy sheet P together with the blank holder 27, and a sealing bead (B1, B2) formed along an edge circumference of the lower mold 23 of the blow-forming mold 20 contacts the aluminum alloy sheet P disposed between the upper mold 25 and the lower mold 23 so as to prevent the leakage of the blowing gas used for blow-deforming the aluminum alloy sheet.

In this condition, the inner sealing bead B1 contacts the aluminum alloy sheet (P) along the trim line thereof and is forcibly inserted therein, and the outer sealing bead B2 contacts the aluminum alloy sheet (P) along an outside of the trim line thereof and is forcibly inserted therein to form a double sealing structure.

Also, a height of the inner sealing bead B1 and the outer sealing bead B2 can be set to a value within a range of 40% to 60% of the thickness of the aluminum alloy sheet to not cut the aluminum alloy sheet (P), and a pressure mark is formed on the upper mold 25 along the trim line and an outer side of the trim line of the aluminum alloy sheet (P) to maintain air-tightness between the lower mold 23 and the aluminum alloy sheet (P).

In a condition in which the blow-sealing step S6 is completed, the blow-forming step S7 is performed.

Figure 8:
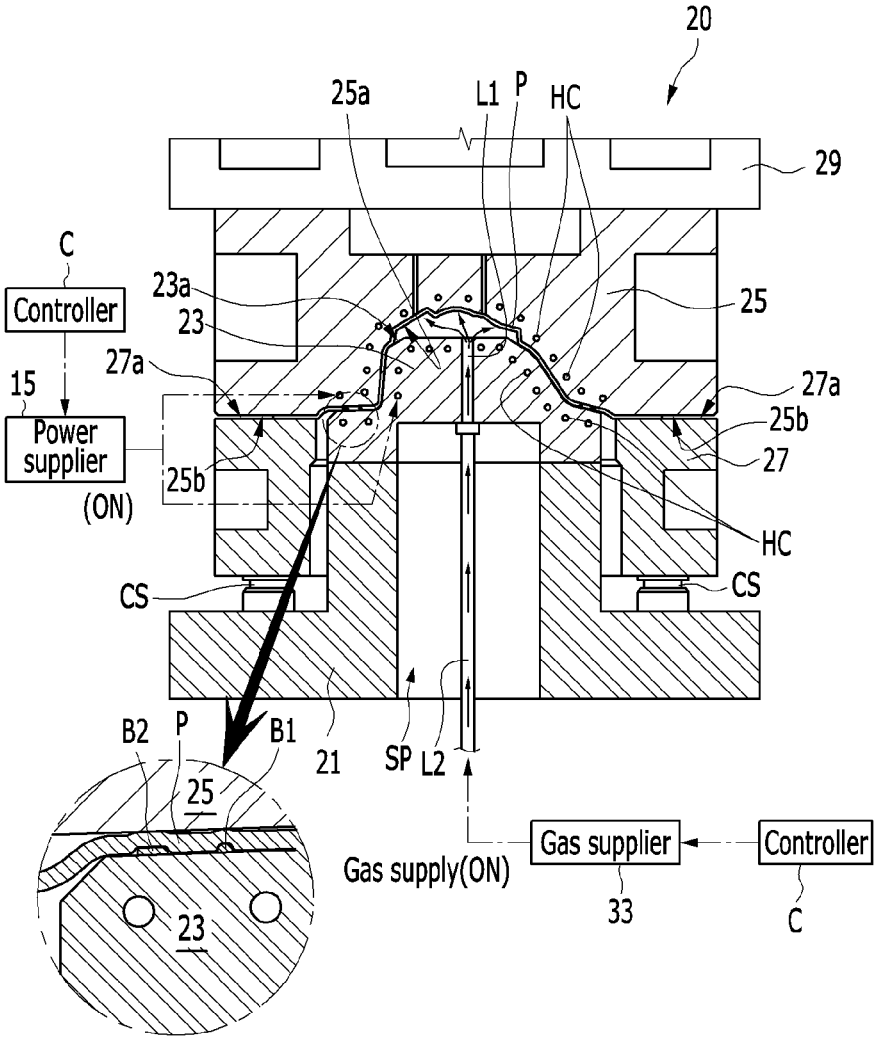

Referring to FIG. 8, the blow-forming step S7 supplies the blowing gas into an interval between the lower mold 23 and the aluminum alloy sheet (P) through a gas passage L1 that is formed in the lower mold 23 of the blow-forming mold 20 and blowing gas pressure performs blow forming to a final shape of a product along an upper mold surface 25*a* of the upper mold 25.

In this process, the gas pressure that is supplied into the interval between the lower mold 23 and the aluminum alloy sheet (P) can be set to 30 bar, wherein the gas pressure expands the aluminum alloy sheet (P) along the upper mold surface 25*a* of the upper mold 25 and the sheet is formed to a final shape of a product to have a complicated structure.

In this condition, the blowing gas is supplied through a gas supply pipe L2 from a gas supplier 33, passes a heating unit (not shown) and is heated to a high temperature, and is supplied through a gas passage L1 in the lower mold 23 at a high temperature and high pressure.

The gas pressure of the blowing gas can be adjusted depending on the thickness of the aluminum alloy sheet (P).

When the blow forming of the aluminum alloy sheet (P) is completed, the product unloading step S8 is performed.

Figure 9:
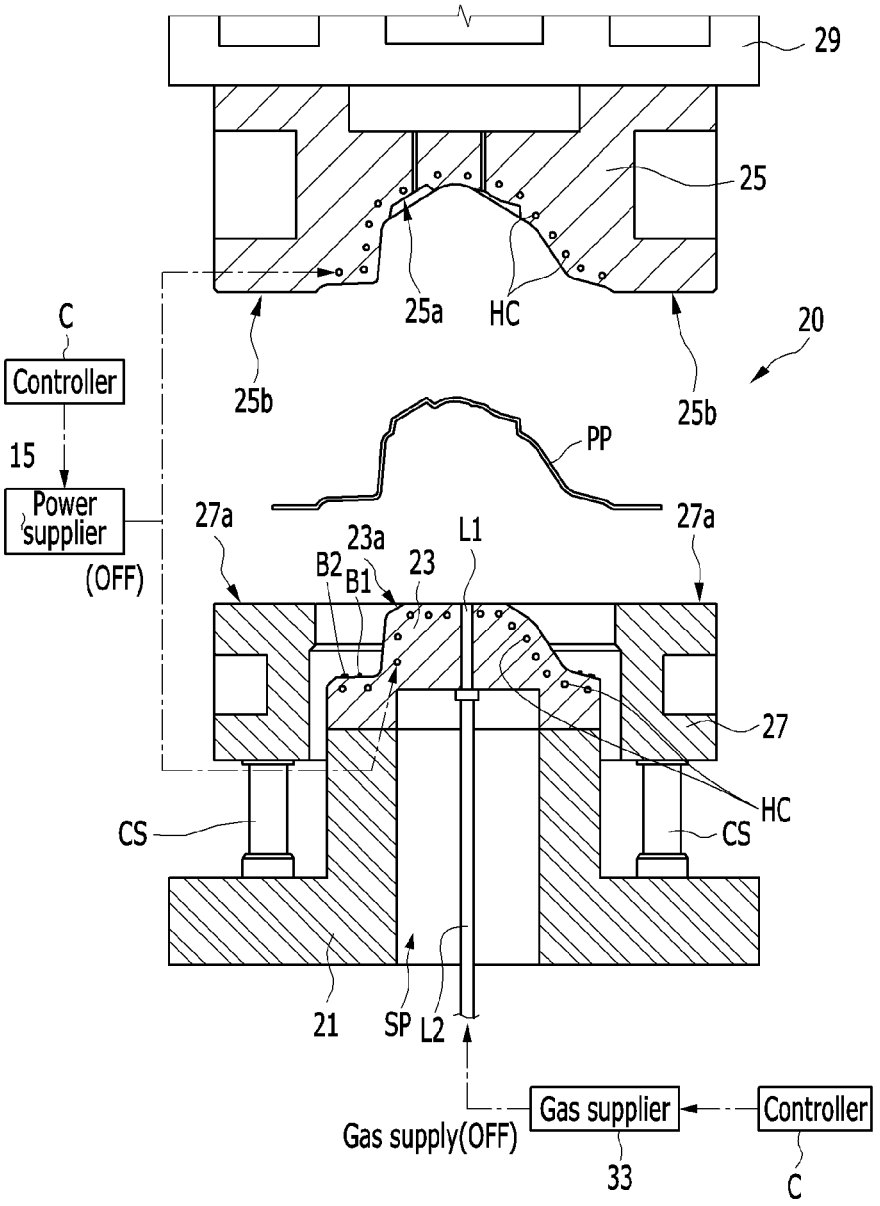

Referring to FIG. 9, in the product unloading step S8, a final aluminum alloy product (PP) is unloaded from the lower mold 23 after the blow-forming is completed to form a sheet to a final shape in the blow-forming mold 20 and the upper mold 25 is separated from the lower mold 23.

In the step-by-step process according to the multi-forming method, an insulation case (not shown) including a micro-porous material is disposed on an outside of the warm-forming mold 10 and the blow-forming mold 20 to minimize heat loss.

In this way, in a multi-forming method according to an exemplary embodiment of the present invention, the molds of the warm-forming mold 10 are combined to warm-deform the aluminum alloy sheet (P) heated to the temperature of less than the annealing temperature thus lowering potential density within the structure to a maximum deformation depth through plastic deformation, the heating device 30 heats the aluminum alloy sheet (P) to the super-plasticity temperature, and the blowing gas blow-deforms the sheet to the final shape in the blow-forming mold 20, and thus the product has a deep deformation depth and a complicated shape and the number of mold components is minimized.

Also, while the product having a deep deformation depth and a complicated shape is being produced, the number of mold components is reduced through minimized processes and it is advantageous in terms of cost.

Further, a part having a complicated shape is formed by blow forming, wherein a high pressure gas deforms the part without contact with a mold, and thus a defect rate is minimized compared to a conventional die-casting method.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

10: warm-forming mold
20: blow-forming mold
1,21: lower mold die
3,23: lower mold
5,25: upper mold
7,27: blank holder
9,21: mold mounting portion
11,31: slider
15,35: power supplier
30: heating device
33: gas supplier
3*a*,23*a*: lower mold surface
5*a*,25*a*: upper mold surface
5*b*,25*b*: upper mold face
7*a*,27*a*: holder face
C: controller
SP: space portion
L1: gas passage
L2: gas supply pipe
H: penetration hole
HC: heating cartridge
CS: cushion spring
B1: inner sealing bead
B2: outer sealing bead
P: aluminum alloy sheet
PP: aluminum alloy product

What is claimed is:

1. A multi-forming method, comprising:

a first material supply step of loading a sheet having super-plasticity on a lower mold that is disposed on a lower mold die of a warm-forming mold and on a blank holder that is disposed on the lower mold die of the warm-forming mold through a cushion spring corresponding to a circumference of the lower mold of the warm-forming mold;

a material warm-heating step of lowering an upper mold of the warm-forming mold operated by a slider at an upper portion of the lower mold of the warm-forming mold to grasp an edge of the sheet together with the blank holder of the warm-forming mold, and heating the sheet to a warm-forming temperature through a heating cartridge disposed in the upper mold of the warm-forming mold, the lower mold of the warm-forming mold, and the blank holder of the warm-forming mold;

a warm-forming step of combining the upper mold of the warm-forming mold with the lower mold of the warm-forming mold by operating the slider of the warm-forming mold to plastic-deforms the sheet to a maximum forming depth of a product along a lower mold surface of the lower mold of the warm-forming temperature;

a material super-plasticity heating step of unloading the sheet, which is warm-deformed to the maximum forming depth of the product, from the warm-forming mold, and heating the sheet to a super-plasticity temperature in a heating device;

a secondary material supply step of loading the sheet heated to the super-plasticity temperature on a lower mold that is disposed on a lower mold die of a blow-forming mold and on a blank holder that is disposed on the lower mold die of the blow-forming mold through a cushion spring corresponding to a circumference of the lower mold of the blow-forming mold;

a blow-sealing step of combining an upper mold of the blow-forming mold operated by a slider of the blow-forming mold with the lower mold of the blow-forming mold at a predetermined pressure, the upper mold of the blow-forming mold grasping an edge of the sheet together with the blank holder of the blow-forming mold, and a sealing bead formed along an edge circumference of the lower mold of the blow-forming mold contacting the sheet disposed between the upper mold of the blow-forming mold and the lower mold of the blow-forming mold so as to prevent leakage of the blowing gas used in blow-deforming of the sheet;

a blow-forming step of supplying a blowing gas into a gap between the lower mold of the blow-forming mold and the sheet through a gas passage that is formed in the lower mold of the blow-forming mold such that the sheet is deformed to a final shape of the product along an upper mold surface of the upper mold of the blow-forming mold; and a product unloading step of separating the upper mold of the blow-forming mold from the lower mold of the blow-forming mold and unloading the product, after the blow-forming step of the sheet to the final shape of the product in the blow-forming mold.

2. The multi-forming method of claim 1, wherein the sheet having super-plasticity is an aluminum alloy.

3. The multi-forming method of claim 1, wherein the gas passage is connected with an outside gas supplier through a gas supply pipe to receive high pressure gas.

4. The multi-forming method of claim 1, wherein the lower mold surface of the lower mold of the warm-forming mold has an incomplete product shape to deform the sheet only to the maximum forming depth.

5. The multi-forming method of claim 1, wherein the upper mold surface of the upper mold of the blow-forming mold has the final shape to deform the sheet to the final shape of the product.

6. The multi-forming method of claim 2, wherein the warm-forming temperature is a value less than an annealing temperature that lowers potential density within a structure of the sheet having super-plasticity, in the material warm-heating step.

7. The multi-forming method of claim 2, wherein the warm-forming temperature is one value within a range of 200° C. to 250° C., in which a grain size of the aluminum alloy is increased, strength thereof is decreased, and ductility thereof is increased.

8. The multi-forming method of claim 6, wherein the warm-forming temperature is one value within a range of 200° C. to 250° C., in which a grain size of the aluminum alloy is increased, strength thereof is decreased, and ductility thereof is increased.

9. The multi-forming method of claim 1, wherein the maximum forming depth of the product is performed by a position movement of the upper mold of the warm-forming mold without pressing of the upper mold of the warm-forming mold, when the upper mold of the warm-forming mold is combined with the lower mold of the warm-forming mold in the warm-forming step.

10. The multi-forming method of claim 1, wherein the heating device is a high frequency induction heating device or an electricity heating device.

11. The multi-forming method of claim 2, wherein the super-plasticity temperature is one value within a range of 500° C. to 540° C. that forms super-plasticity of the aluminum alloy.

12. The multi-forming method of claim 1, wherein the secondary material supply step further comprises a step of pre-heating the blow-forming mold to a predetermined temperature.

13. The multi-forming method of claim 12, wherein the predetermined temperature is within a range of 350° C. to 500° C.

14. The multi-forming method of claim 1, wherein the sealing bead of the blow-forming mold comprises:

an inner sealing bead that protrudes along an edge circumference of the lower mold and a front end portion thereof contacts the sheet to be forcibly inserted into the sheet; and an outer sealing bead that protrudes along the edge circumference of the lower mold at an outer side of the inner sealing bead and a front end portion thereof contacts the sheet to be forcibly inserted into the sheet.

15. The multi-forming method of claim 14, wherein a height of the inner and outer sealing beads is within a range of 40% to 60% of the sheet thickness.

16. The multi-forming method of claim 14, wherein the inner sealing bead is formed along a trim line of the sheet.

17. The multi-forming method of claim 15, wherein the inner sealing bead is formed along a trim line of the sheet.

18. The multi-forming method of claim 1, wherein the predetermined pressure is 400 t in the blow-sealing step.

19. The multi-forming method of claim 1, wherein a pressure of the blowing gas that is supplied between the lower mold and the sheet is 30 bar in the blow-forming step.

* * * * *